US009117458B2

(12) United States Patent
Oh et al.

(10) Patent No.: US 9,117,458 B2
(45) Date of Patent: Aug. 25, 2015

(54) APPARATUS FOR PROCESSING AN AUDIO SIGNAL AND METHOD THEREOF

(75) Inventors: Hyen-O Oh, Seoul (KR); Chang Heon Lee, Seoul (KR); Hong Goo Kang, Seoul (KR)

(73) Assignees: LG Electronics Inc., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 334 days.

(21) Appl. No.: 13/509,306

(22) PCT Filed: Nov. 2, 2010

(86) PCT No.: PCT/KR2010/007987

§ 371 (c)(1),
(2), (4) Date: May 11, 2012

(87) PCT Pub. No.: WO2011/059255

PCT Pub. Date: May 19, 2011

(65) Prior Publication Data

US 2013/0013321 A1 Jan. 10, 2013

Related U.S. Application Data

(60) Provisional application No. 61/260,818, filed on Nov. 12, 2009.

(51) Int. Cl.

| | |
|---|---|
| ***G10L 19/00*** | (2013.01) |
| ***G10L 21/00*** | (2013.01) |
| ***G10L 21/038*** | (2013.01) |
| *G10L 19/02* | (2013.01) |
| *G10L 19/038* | (2013.01) |
| *G10L 19/04* | (2013.01) |

(52) U.S. Cl.
CPC ..... *G10L 21/038* (2013.01); *G10L 19/0204* (2013.01); *G10L 19/038* (2013.01); *G10L 19/04* (2013.01)

(58) Field of Classification Search
None
See application file for complete search history.

(56) References Cited

U.S. PATENT DOCUMENTS 5,774,847 A * 6/1998 Chu et al. ..... 704/237
5,790,759 A * 8/1998 Chen ..... 704/200.1

(Continued)

FOREIGN PATENT DOCUMENTS

EP 2077550 A1 7/2009

OTHER PUBLICATIONS

PCT International Search Report dated Jul. 14, 2011 for Application No. PCT/KR2010/007987, 3 pages.

*Primary Examiner* — Richemond Dorvil
*Assistant Examiner* — Thuykhanh Le
(74) *Attorney, Agent, or Firm* — Fish & Richardson P.C.

(57) ABSTRACT

A method of processing an audio signal is disclosed. The present invention includes a method for processing an audio signal, comprising: receiving, by an audio processing apparatus, the spectral data including a current block, and substitution type information indicating whether to apply a shape prediction scheme to a current block; when the substitution type information indicates that the shape prediction scheme is applied to the current block, receiving lag information indicating an interval between spectral coefficients of the current block and the predictive shape vector of a current frame or a previous frame; obtaining spectral coefficients by substituting for spectral hole included in the current block using the predictive shape vector.

17 Claims, 10 Drawing Sheets

(56) References Cited

U.S. PATENT DOCUMENTS

| | | | | |
|---|---|---|---|---|
| 6,014,621 | A * | 1/2000 | Chen | 704/220 |
| 6,658,378 | B1 * | 12/2003 | Maeda | 704/200.1 |
| 2003/0233234 | A1 * | 12/2003 | Truman et al. | 704/256 |
| 2007/0291959 | A1 * | 12/2007 | Seefeldt | 381/104 |
| 2009/0006103 | A1 * | 1/2009 | Koishida et al. | 704/500 |
| 2009/0097676 | A1 * | 4/2009 | Seefeldt | 381/107 |
| 2009/0144055 | A1 * | 6/2009 | Davidson et al. | 704/226 |
| 2009/0210222 | A1 * | 8/2009 | Mehrotra et al. | 704/230 |
| 2010/0169081 | A1 * | 7/2010 | Yamanashi et al. | 704/203 |
| 2010/0211399 | A1 * | 8/2010 | Liljeryd et al. | 704/500 |
| 2010/0286990 | A1 * | 11/2010 | Biswas et al. | 704/500 |
| 2010/0286991 | A1 | 11/2010 | Hedelin et al. | |
| 2011/0010168 | A1 * | 1/2011 | Yu et al. | 704/219 |
| 2011/0173012 | A1 * | 7/2011 | Rettelbach et al. | 704/500 |

* cited by examiner (A)

(B)

APPARATUS FOR PROCESSING AN AUDIO SIGNAL AND METHOD THEREOF

CROSS REFERENCE TO RELATED APPLICATIONS

This application is a U.S. National Phase Application under 35 U.S.C. §371 of International Application PCT/KR2010/007987, filed on Nov. 12, 2010, which claims the benefit of U.S. Provisional Application No. 61/260,818, filed on Nov. 12, 2009, the entire contents of which are hereby incorporated by reference in their entireties.

TECHNICAL FIELD

The present invention relates to an apparatus for processing an audio signal and method thereof. Although the present invention is suitable for a wide scope of applications, it is particularly suitable for encoding or decoding an audio signal.

BACKGROUND ART

Generally, an audio property based coding scheme is used for such an audio signal as a music signal. A speech property based coding scheme is used for a speech signal.

DISCLOSURE OF THE INVENTION

Technical Problem

However, in case of applying one of coding schemes to a signal having audio and speech properties coexist therein, it causes a problem that audio coding efficiency and/or sound quality is degraded.

Moreover, when spectral coefficients generated through frequency transform are quantized, if a bit rate is low, quantization error increases, therefore a spectral hole in which a transmitted data becomes approximate zero increases. Hence, it causes a problem that a sound quality is degraded.

Technical Solution

Accordingly, the present invention is directed to an apparatus for processing an audio signal and method thereof that substantially obviate one or more of the problems due to limitations and disadvantages of the related art.

An object of the present invention is to provide an apparatus for processing an audio signal and method thereof, by which one of at least two coding schemes is applied to one frame (or subframe).

Another object of the present invention is to provide an apparatus for processing an audio signal and method thereof, by which a decoder can compensate for a spectral hole in a spectral hole generated interval.

Another object of the present invention is to provide an apparatus for processing an audio signal and method thereof, by which a shape prediction scheme is performed using a most similar coefficient of a previous or current frame in order to compensate a spectral hole to become closest to an original signal.

A further object of the present invention is to provide an apparatus for processing an audio signal and method thereof, by which a spectral hole can be substituted based on a perceptual gain value for compensating the spectral hole by applying a psychoacoustic model.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method for processing an audio signal, comprising: receiving, by an audio processing apparatus, the spectral data including a current block, and substitution type information indicating whether to apply a shape prediction scheme to a current block; when the substitution type information indicates that the shape prediction scheme is applied to the current block, receiving lag information indicating an interval between spectral coefficients of the current block and the predictive shape vector of a current frame or a previous frame; obtaining spectral coefficients by substituting for spectral hole included in the current block using the predictive shape vector.

According to the present invention, the method further comprises receiving prediction type information indicating whether a prediction mode of the shape prediction scheme is intra-frame mode or inter-frame mode, wherein the spectral coefficients are obtained using further the prediction mode.

According to the present invention, when the prediction mode is intra-frame mode, the predictive shape vector is decided by the spectral data of the current frame, when the prediction mode is inter-frame mode, the predictive shape vector is decided by the spectral data of the previous frame.

According to the present invention, the predictive shape vector is determined by the spectral data of the current frame or the previous frame as far as the interval from the current block.

According to the present invention, the method further comprises when the type information indicates that the shape prediction scheme is not applied to the current block, receiving a perceptual gain value, wherein the perceptual gain value is determined by psychoacoustic model and correlation; obtaining spectral coefficients by substituting for the spectral hole included in the current block using the perceptual gain value.

According to the present invention, the psychoacoustic model is based on excitation pattern obtained by smoothing energy pattern of frequency band, the perceptual gain value is further independent on the psychoacoustic model when the correlation increases, and the perceptual gain value is further dependent on the psychoacoustic model when the correlation decreases.

According to the present invention, the current block corresponds to at least one of a current band and a current frame including the current band.

To further achieve these and other advantages and in accordance with the purpose of the present invention, a method for processing an audio signal, comprising: receiving, by an audio processing apparatus, spectral coefficients of an input audio signal; detecting spectral hole by de-quantizing the spectral coefficient; estimating at least one correlation between at least one candidate shape vector and a current block covering the spectral hole; determining substitution type information indicating whether to apply a shape prediction scheme to the current block based on the at least one correlation; when the shape prediction scheme is applied to the current block, determining the prediction mode information and lag information, based on the at least one correlation; and, transmitting the substitution type information, the prediction mode information and the lag information, wherein: the prediction mode information indicates whether a prediction mode of the shape prediction scheme is intra-frame mode or inter-frame mode, and, the lag information indicates an interval between spectral coefficients of the current block and the predictive shape vector of a current frame or a previous frame is provided.

To further achieve these and other advantages and in accordance with the purpose of the present invention, a method for processing an audio signal, comprising: receiving, by an audio processing apparatus, spectral coefficients of an input audio signal; detecting spectral hole by de-quantizing the spectral coefficient; estimating correlation between current spectral coefficients covering the spectral hole and the candidate spectral coefficients; generating a perceptual gain value using the spectral coefficients, the correlation and psychoacoustic model; wherein: the psychoacoustic model is based on excitation pattern obtained by smoothing energy pattern of frequency band, the perceptual gain value is further independent on the psychoacoustic model when the correlation increases, and the perceptual gain value is further dependent on the psychoacoustic model when the correlation decreases is provided.

To further achieve these and other advantages and in accordance with the purpose of the present invention, an apparatus for processing an audio signal, comprising: a substitution type extracting unit receiving the spectral data including a current block, and substitution type information indicating whether to apply a shape prediction scheme to a current block; a lag extracting unit, when the substitution type information indicates that the shape prediction scheme is applied to the current block, receiving lag information indicating an interval between spectral coefficients of the current block and the predictive shape vector of a current frame or a previous frame; a shape substitution unit obtaining spectral coefficients by substituting for spectral hole included in the current block using the predictive shape vector is provided.

According to the present invention, the lag extracting unit receives prediction type information indicating whether a prediction mode of the shape prediction scheme is intra-frame mode or inter-frame mode, the spectral coefficients are obtained using further the prediction mode.

According to the present invention, when the prediction mode is intra-frame mode, the predictive shape vector is decided by the spectral data of the current frame, when the prediction mode is inter-frame mode, the predictive shape vector is decided by the spectral data of the previous frame.

According to the present invention, the predictive shape vector is determined by the spectral data of the current frame or the previous frame as far as the interval from the current block.

According to the present invention, the method further comprises a gain extracting unit, when the type information indicates that the shape prediction scheme is not applied to the current block, receiving a perceptual gain value, wherein the perceptual gain value is determined by psychoacoustic model and correlation; and, a gain substitution unit obtaining spectral coefficients by substituting for the spectral hole included in the current block using the perceptual gain value.

According to the present invention, the psychoacoustic model is based on excitation pattern obtained by smoothing energy pattern of frequency band, the perceptual gain value is further independent on the psychoacoustic model when the correlation increases, and the perceptual gain value is further dependent on the psychoacoustic model when the correlation decreases.

According to the present invention, the current block corresponds to at least one of a current band and a current frame including the current band.

To further achieve these and other advantages and in accordance with the purpose of the present invention, an apparatus for processing an audio signal, comprising: a hole detecting unit receiving spectral coefficients of an input audio signal, and detecting spectral hole by de-quantizing the spectral coefficient; a substitution type selecting unit estimating at least one correlation between at least one candidate shape vector and a current band covering the spectral hole; and, determining substitution type information indicating whether to apply a shape prediction scheme to the current band based on the at least one correlation; a shape prediction unit, when the shape prediction scheme is applied to the current band, determining the prediction mode information and lag information, based on the at least one correlation; and, a multiplexing unit transmitting the substitution type information, the prediction mode information and the lag information, wherein: the prediction mode information indicates whether a prediction mode of the shape prediction scheme is intra-frame mode or inter-frame mode, and the lag information indicates an interval between spectral coefficients of the current block and the predictive shape vector of a current frame or a previous frame is provided.

To further achieve these and other advantages and in accordance with the purpose of the present invention, an apparatus for processing an audio signal, comprising: a hole detecting unit receiving spectral coefficients of an input audio signal, and detecting spectral hole by de-quantizing the spectral coefficient; a substitution type selecting unit estimating correlation between current spectral coefficients covering the spectral hole and the candidate spectral coefficients; a gain generating unit generating a perceptual gain value using the spectral coefficients, the correlation and psychoacoustic model; wherein: the psychoacoustic model is based on excitation pattern obtained by smoothing energy pattern of frequency band, the perceptual gain value is further independent on the psychoacoustic model when the correlation increases, and the perceptual gain value is further dependent on the psychoacoustic model when the correlation decreases is provided.

It is to be understood that both the foregoing general description and the following detailed description are exemplary and explanatory and are intended to provide further explanation of the invention as claimed.

Advantageous Effects

Accordingly, the present invention provides the following effects or advantages.

First of all, if a spectral hole failing to transmit meaningful data is generated in a low bit rate environment, the present invention compensates the spectral hole using a shape or pattern of spectral data used to exist previously rather than using a gain of a constant value, thereby generating a signal closer to an original signal.

Secondly, whether to apply a shape prediction scheme to a current band having a spectral hole occur therein is adaptively determined according to correlation with a previous spectral data. Therefore, a decoder is able to substitute the spectral hole by a scheme most suitable for the corresponding band, thereby generating a signal having a better sound quality.

Thirdly, in case that the correlation with a spectral data used to exist is low, the present invention uses a perceptual gain based on a psychoacoustic theory rather than a gain of a constant value, thereby minimizing a sound quality distortion in a user listening situation.

Finally, when a perceptual gain value is generated, a psychoacoustic influence adaptively changes according to correlation, the present invention further elaborates a gain control for substituting a spectral hole.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

According to the present invention, terminologies not disclosed in this specification can be construed as the following meanings and concepts matching the technical idea of the present invention. Specifically, 'coding' can be construed as 'encoding' or 'decoding' selectively and 'information' in this disclosure is the terminology that generally includes values, parameters, coefficients, elements and the like and its meaning can be construed as different occasionally, by which the present invention is non-limited.

In this disclosure, in a broad sense, an audio signal is conceptionally discriminated from a video signal and designates all kinds of signals that can be auditorily identified. In a narrow sense, the audio signal means a signal having none or small quantity of speech property. Audio signal of the present invention should be construed in a broad sense. Yet, the audio signal of the present invention can be understood as an audio signal in a narrow sense in case of being used as discriminated from a speech signal.

Although coding is specified to encoding only, it can be also construed as including both encoding and decoding.

Figure 1:
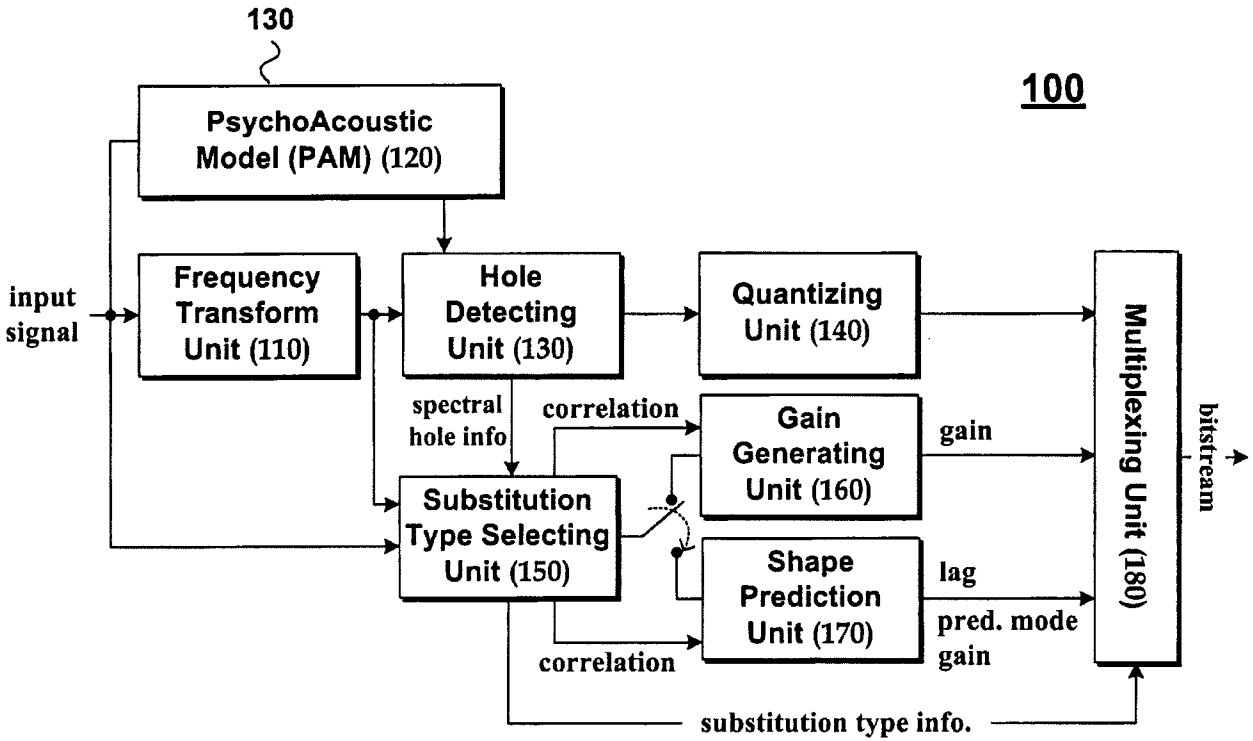
FIG. 1 is a block diagram of an encoder in an audio signal processing apparatus according to the present invention.
Figure 2:
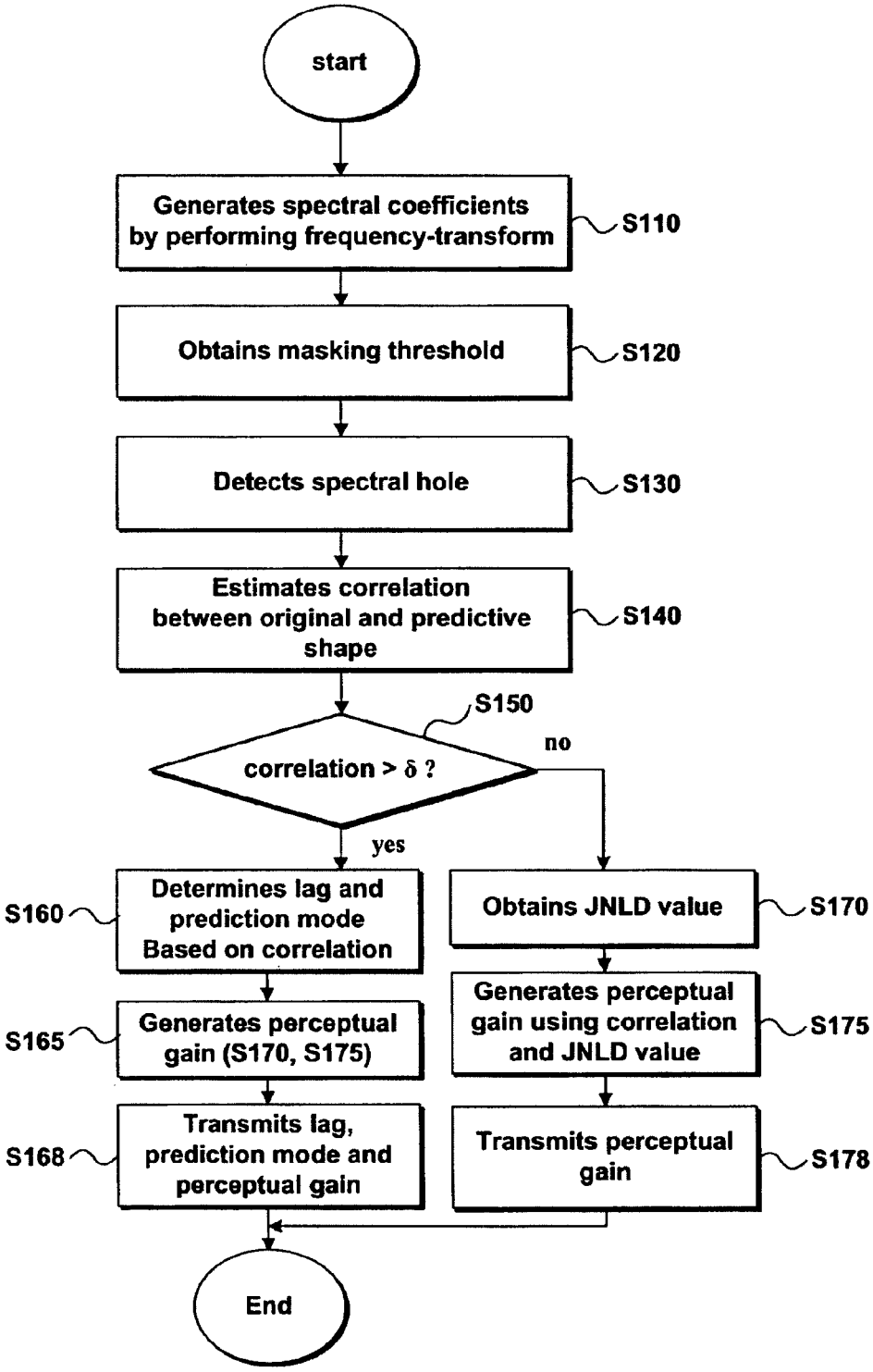
FIG. 2 is a flowchart of an encoding step in an audio signal processing method.

FIG. 1 is a block diagram of an encoder in an audio signal processing apparatus according to the present invention. And, FIG. 2 is a flowchart of an encoding step in an audio signal processing method.

Referring to FIG. 1, an encoder 100 in an audio signal processing apparatus according to the present invention includes at least one of a substitution type selecting unit 150, a gain generating unit 160 and a shape prediction unit 170 and is able to further include a frequency transform unit 110, a psychoacoustic model (PAM) 120, a hole detecting unit 130 and a quantizing unit 140.

In the following description, the functions and roles of the respective components shown in FIG. 1 are explained with reference to FIG. 1 and FIG. 2.

First of all, the frequency transform unit 110 receives an input audio signal and then generates spectral coefficients by performing frequency transform on the received input audio signal [S110]. In this case, the input audio signal can include a broad-sense audio signal including a speech signal or a mixed signal. Meanwhile, the frequency transform can be performed in various ways and includes one of MDCT (modified discrete transform), WPD (wavelet packet transform), FV-MLT (frequency varying modulated lapped transform) and the like. Moreover, the frequency transform is not specified to a specific scheme.

The psychoacoustic model 120 receives the spectral coefficients and then generates a masking threshold T (n) based on a psychoacoustic model using the received spectral coefficients [S120].

In this case, the masking threshold is provided to apply a masking effect. And, the masking effect is attributed to a psychoacoustic theory based on the following fact. First of all, since small signals adjacent to a big signal are blocked by the big signal, a human auditory organ is not good at recognizing the small signals. For instance, a biggest signal exists in the middle among a plurality of data corresponding to a frequency band and several signals much smaller than the biggest signal can exist in the vicinity of the biggest signal. The biggest signal becomes a masker and a masking curve is then drawn with reference to the masker. The small signal blocked by the masking curve becomes a masked signal or a maskee. If the rest of the signals except the masked signal are set to remain as valid signals, it is called 'masking'.

Meanwhile, the masking threshold is generated in a following manner. First of all, spectral coefficients can be divided by scale factor band unit. And, an energy $E_n$ can be found per scale factor band. A masking scheme attributed to the psychoacoustic model theory can be applied to the found energy values. The masking curve is then obtained from each masker that is the energy value of the scale factor unit. If the respective masking curves are connected, it is able to obtain an overall masking curve. With reference to this masking curve, it is able to obtain the masking threshold that is the base of quantization per scale factor band.

Meanwhile, an interval removed by the masking effect is basically set to 0, and this interval can be a spectral hole. The spectral hole can be reconstructed by a decoder if necessary. This shall be explained in the description of a decoder later.

Meanwhile, the masking threshold T(n) generated in the step S120 can be modified by Formula 1 [S125, not shown in the drawing].

$$T_r(n)=(T(n)^{0.25}+r)^4 \quad \text{[Formula 1]}$$

In Formula 1, T(n) is the masking threshold generated in the step S120, $T_r(n)$ is a modified masking threshold, and 'r' indicates loudness.

If a bit rate is low, since bits allocated to each band are small, a masking curve or a masking threshold should be raised. In doing so, by linearly adding the loudness r to the masking threshold, as shown in Formula 1, the masking threshold can be raised. A sound volume or loudness r (unit: phone) is conceptionally discriminated from a sound intensity (unit: dB) and represents the intensity of sound perceived by a human ear. The sound volume or the loudness r depends on sound duration, sound generated time, spectral property and the like as well as the sound intensity. For reference, despite the same sound intensity (dB), a human organ senses that a sound volume (phone) of a sound on a low or high frequency band is low. And, the human organ perceives that a sound on a middle band has a relatively high sound volume.

In case of a low bit rate, if a masking threshold is raised in a manner of applying the loudness (i.e., sound volume) to the masking threshold generated in the step S120, small bits can be allocated.

The hole detecting unit 130 detects a spectral hole using the spectral coefficients generated in the step SI 10 and the masking threshold generated in the step SI 20 [SI 30]. The spectral hole means an interval, in which the quantized spectral coefficients (or spectral data) are zero or approximate zero. The spectral hole can occurs when original coefficient with small value becomes approximate zero after quantization, and the spectral hole can occur when original coefficient becomes approximate zero by the masking effect, as mentioned in the foregoing description.

For the latter case, a process for detecting the spectral hole will be described in detail as follow. Besides, the spectral hole shall be described one more time with reference to FIG. 5 later in this disclosure.

First of all, by performing masking and quantization using the masking threshold generated in the steps S120 to S125, a scale factor and spectral data are obtained from the spectral coefficients. The spectral coefficient can be similarly represented using a scale factor of integer and a spectral data of integer in Formula 2. Thus, the representation as the two integer factors is the quantization process.

$$X \cong 2^{\frac{scalefactor}{4}} \times \text{spectral_data}^{\frac{4}{3}} \quad \text{[Formula 2]}$$

In Formula 2, the X indicates a spectral coefficient, the scalefactor indicates a scale factor, and the spectral_data indicates spectral data.

Referring to FIG. 2, it is able to observe a sign of inequality. As each of the scale factor and the spectral data has an integer only, it is unable to represent all of arbitrary X according to a resolution of the corresponding value. That is why a sign of equality is not established. Hence, a right side of Formula 1 can be represented as X' shown in Formula 3.

$$X' = 2^{\frac{scalefactor}{4}} \times \text{spectral_data}^{\frac{4}{3}} \quad \text{[Formula 3]}$$

Meanwhile, the scalefactor is a factor applicable to a group (e.g., a specific band, a specific interval, etc.). By transforming sizes of coefficients belonging to the specific group using a scale factor representing a specific group (e.g., scalefactor band), coding efficiency can be raised.

Meanwhile, in the course of quantizing the spectral coefficients, error may be generated. This error signal can be regarded as a difference between the original coefficient X and the value X' according to the quantization, which is shown in Formula 3.

$$\text{Error}=X-X' \quad \text{[Formula 4]}$$

In Formula 4, the X is represented as Formula 2 and the X' is represented as Formula 3.

Energy corresponding to the error signal (Error) is a quantization error $E_{error}$.

To meet the condition shown in Formula 5 using the obtained masking threshold $T_r(n)$ and the quantization error $E_{error}$, scale factor and spectral data are found.

$$T_r(n)>E_{error} \quad \text{[Formula 5]}$$

In Formula 5, the $T_r(n)$ indicates a masking threshold and the $E_{error}$ indicates a quantization error.

In particular, if the above condition is met, since the quantization error becomes smaller than the masking threshold, it means that energy of noise attributed to the quantization is blocked due to a masking effect. In other words, the noise attributed to the quantization may not be heard by a listener. Yet, if the above condition is not met, since the quantization error is greater than the masking threshold, distortion of sound quality may occur. A spectral hole can be generated when this interval is set to zero.

Thus, if the scale factor and the spectral data are transmitted to meet the above condition, a decoder is able to generate a signal almost identical to an original audio signal using the scale factor and the spectral data. Yet, as quantization resolution is insufficient due to shortage of a bit rate, if an interval in which the above condition is not met increases, a sound quality may be degraded.

The substitution type selecting unit 150 estimates correlation for the spectral hole detected in the step S130 [S140] and then selects whether to apply a shape prediction scheme to substitute the spectral hole based on the estimated correlation [S150].

<Predictive Spectral Shape Estimation>

In the following description, a process for estimating correlation and a process for determining a shape prediction scheme are explained in detail First of all, prior to estimating correlation, definitions of a predictive shape vector, prediction mode information and lag are explained as follows.

$$\tilde{X}_{m,i} = \frac{\hat{X}_{m,i}}{\sqrt{\hat{X}_{m,i}\hat{X}_{m,i}^T}}, \quad \text{[Formula 6]}$$

$$\hat{X}_{m,i} = [X_{q,m-K}(T_i - D_{m,i}), \ldots, X_{q,m-K}(T_i + N_i - 1 - D_{m,i})]$$

In Formula 6, $\tilde{X}_{m,i}$ indicates a unit predictive shape vector of $i^{th}$ frequency band of $m^{th}$ frame. $\hat{X}_{m,i}$ indicates a predictive shape vector of $i^{th}$ frequency band of $m^{th}$ frame. $X_{q,m}(n)$ indicates a quantized spectral coefficient of $m^{th}$ frame. The $N_i$ indicates the number of frequency bins of $i^{th}$ frequency band. The $T_i$ indicates an index of a first bin of $i^{th}$ frequency band. The K indicates prediction mode information. And, the $D_{m,i}$ indicates a lag.

In this case, the unit predictive shape vector $\tilde{X}_{m,i}$ is determined by the predictive shape vector $\hat{X}_{m,i}$, as shown in Formula 6, and has unit energy. The predictive shape vector or the unit predictive shape vector, as shown in the formula, is a spectral shape vector.

Meanwhile, if the prediction mode information K is 0, it indicates an intra frame direction. If the prediction mode information K is 1, it indicates an inter frame direction. In particular, in case of an inter frame, a predictive shape vector is found not in a current frame (e.g., $m^{th}$ frame) but in a previous frame. In case of an intra frame, a predictive shape vector is found in a current frame (e.g., $m^{th}$ frame).

Meanwhile, the prediction direction information K and the lag $D_{m,i}$ can be determined by correlation as follows.

$$[K, D_{m,i}] = \underset{[k\in\{0,1\},d_k]}{\operatorname{argmax}} R^k_{m,i}(d_k) \quad \text{[Formula 7-1]}$$

$$R^k_{m,i}(d_k) = \frac{\sum_{n=0}^{N_i-1} X_m(n+T_i)X_{q,m-k}(n+T_i-d_k)}{\sqrt{\sum_{n=0}^{N_i-1} X_m^2(n+T_i)\cdot\sum_{n=0}^{N_i-1} X^2_{q,m-k}(n+T_i-d_k)}} \quad \text{[Formula 7-2]}$$

In this case, $X_m(n)$ indicates a spectral coefficient of $m^{th}$ frame (or spectral coefficient of a current band in current frame). $X_{q,m}-k(n+T_i-d_k)$ indicates a quantized candidate spectral coefficient, i.e., a spectral coefficient of $(m-k)^{th}$ frame, and is a spectral coefficient corresponding to a bin spaced apart from a current spectral coefficient $K_m(n)$ or $X_m(n+T_i)$ by a candidate lag $d_k$. The candidate lag $d_k$ is a difference between a candidate spectral coefficient and a current spectral coefficient. $R^k_{m,i}(d_k)$ indicates a correlation between a current spectral coefficient $X_m(n+T_i)$ and a candidate spectral coefficient $X_{q,m-k}(n+T_i-d_k)$. The $T_i$ is an index of a first bin of $i^{th}$ frequency band. And, the $N_i$ indicates the number of frequency bands of $i^{th}$ frequency band.

In this case, the current spectral coefficient $X_m(n+T_i)$ is a current spectral coefficient that covers the spectral hole detected in the step S130. Moreover, the candidate lag $d_k$ is set to cover a pitch range in consideration that a pith range of a speech signal is about between 60 Hz and 400 Hz. In the prediction mode is the intra frame mode, the range of the candidate lag becomes [Ni, Ni+Δ−1]. If a sampling frequency is 48 kHz, for instance, one frequency bin corresponds to about 11.7 Hz (in 2:1 downsampled domain actually operating on a core coding layer). Hence, Δ needs to be set to meet the restriction as 11.7≠Δ>400. If the prediction mode is the inter frame mode, a range of the candidate lag is set to [−Δ/2, Δ/2−1].

The substitution type selecting unit 150 estimates the correlation according to Formula 7-2 [SI 40]. Base on the correlation estimated in the step SI 40, the substitution type selecting unit 150 determines whether to apply a shape prediction scheme to the spectral hole (or a current block including a hole) detected in the step SI 30. The current block corresponds to a current band or a current frame including the current band. The substitution type selecting unit 150 generates substitution type information indicating the determination and then delivers the generated substitution type information to the multiplexing unit 180 [SI 50]. For instance, if there exists a value equal to or greater than a correlation predetermined value δamong the candidate lag values (and prediction mode), the shape prediction scheme is applied. If a value equal to or greater than a correlation predetermined value δdoes not exist among the candidate lag values (and prediction mode), the shape prediction scheme is not applied.

In case of determining not to apply the shape prediction scheme to the current block in the step S150 [yes in the step S150], the shape prediction unit (170) determines the lag (value) $D_{m,i}$ and the prediction mode information K from the candidate lag $d_k$ and the prediction mode according to Formula 7-1 [SI 60].

The shape prediction unit (170) estimates perceptual gain according to steps of S170 and S175 [S165]. The steps of S170 and S175 will be explained.

The substitution type information generated in the step S150 and the delay value, prediction mode information generated in the step S160, and the perceptual gain generated in the step S165 are included in a bitstream by the multiplexing unit 180. The multiplexing unit 180 then transmits the bitstream [S168].

<Perceptual Gain Control>

On the contrary, in case of determining not to apply the shape prediction scheme to the current band in the step S150 [No in the step S150], the gain generating unit 160 generates only a gain to control a gain perceptually without applying the shape prediction scheme. For instance, in case of non-tonal or non-harmonic spectral coefficients, it is inappropriate to apply the shape prediction scheme. In order to minimize the perceptual distortion, it is appropriate to further lower a gain to prevent an unwanted coefficient from being boosted.

In order to generate a gain for a perceptual control, JNLD (Just Noticeable Level Difference) value is generated [SI 70] and a gain is generated using the JNLD value and correlation [SI 75]. In the following description, the step SI 70 and the step SI 75 are described in detail.

First of all, a gain can be generated based on a psychoacoustic background indicating that the decrease of a spectral level is less perceptual than the increase of the level in the quantization process. Specifically, in case of a speech signal, since quantization error existing between harmonics or in a valley region between formants is very sensitive, if a gain is decreased, it is more effective to reduce the perceptual distortion. As the considerable decrease may cause unpredictable perceptual distortion, a lower limit of the decreasing gain value needs to be set. This can be based on the theory on JNLD concept. The JLND is a detection threshold for a level difference and teaches that a human ear is not able to sensitively perceive a spectral level difference within the JNLD threshold. The JNLD depends on a level of an excitation pattern and can be represented as Formula 8.

$$J_{m,i} = 5.95072\cdot\left(\frac{6.39468}{E_{m,i}}\right)^{1.71332} + 9.01033\cdot 10^{-11}\cdot E^4_{m,i} + 5.05622\cdot 10^{-6}\cdot E^3_{m,i} - 0.00102438\cdot E^2_{m,i} + 0.0550197\cdot E_{m,i} - 0.198719, \quad \text{[Formula 8]}$$

In Formula 8, $J_{m,i}$ indicates JNLD value. $E_{m,i}$ indicates an excitation pattern (dB) of $i^{th}$ frequency band of $m^{th}$ frame.

It is able to obtain the excitation pattern by smoothing an energy pattern of each frequency band using a spreading function. The JNLD value is defined only if $E_{m,i}>0$. Otherwise, the JNLD value is set to $1.0\times10^{30}$.

The JNLD value is characterized in increasing sensitivity to a small difference for a loud signal but needing a big level difference to detect a level change of a weak signal.

The gain generating unit 160 generates a perceptual gain value based on the psychoacoustic theory using the JNLD value generated in the step S170 and the correlation in the step S130 [S175]. And, the perceptual gain value can be generated according to Formula 9-1 and Formula 9-2.

$$\tilde{g}_{m,i} = \alpha \cdot g_{m,i} + (1-\alpha) \cdot \sqrt{g_{m,i}^2 \cdot 10^{-J_{m,i}/10}}, \quad \text{[Formula 9-1]}$$

$$g_{m,i} = \sqrt{\sum_{n=0}^{N_i-1} X_m^2(n+T_i)} \quad \text{[Formula 9-2]}$$

In this case, $\alpha$ ($0<\alpha\leq 1$) indicates correlation between the spectral coefficient of the current band and the candidate spectral coefficient (or the predictive shape vector) shown in Formula 7-2. The $J_{m,i}$ indicates the JNLD value shown in Formula 8. The $X_m$ indicates a spectral coefficient of $m^{th}$ frame. The $N_i$ indicates the number of frequency bins of $i^{th}$ frequency band. The $T_1$ indicates an index of first bin of the $i^{th}$ frequency band.

Figure 6:
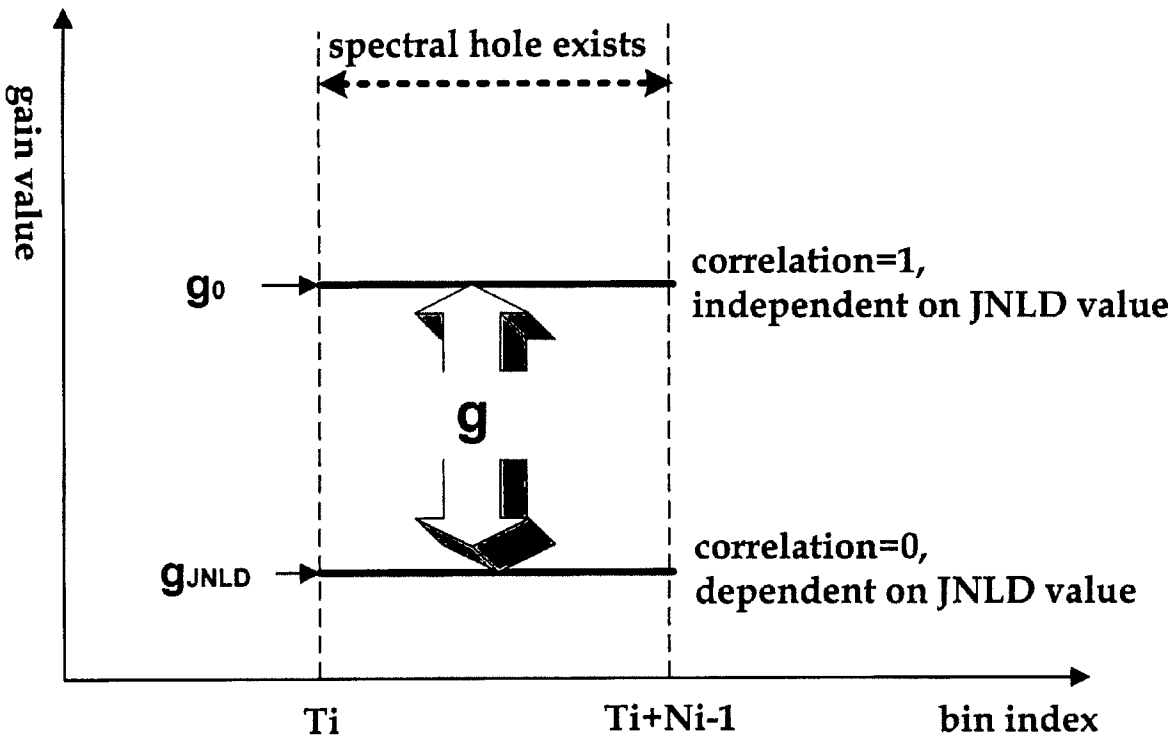
FIG. 6 is a diagram for a range of a perceptual gain.

Meanwhile, a range of the perceptual gain value shall be described one more time in FIG. 6 later. Using the perceptual gain value generated according to Formula 9-1 and Formula 9-2, it is able to control a gain based on the psychoacoustic theory. Thus, the correlation between the predictive shape vector and the original signal (e.g., the spectral coefficient of the current band) is reflected on the gain control as well.

Meanwhile, $\sqrt{g_{m,i}^2 \cdot 10^{-J_{m,i}/10}}$ is determined on the assumption that a corresponding band has JNLD threshold energy $(\Sigma_{n=0}^{N_i-1} X_m^2(n+T_i)) \cdot 10^{-J_{m,i}/10}$ Referring to Formula 9-1, according to the correlation of the predictive shape, the gain value is adaptively controller. If the shape is predicted close to the original, a value of the correlation $\alpha$ becomes almost 1. Hence, the gain value will become almost $g_{m,i}$. In particular, energy of a band (i.e., a band having a spectral hole exist therein) to substitute becomes almost equal to the energy of the original spectral band. On the contrary, if a difference between a predictive shape and an original shape gets bigger (i.e., if the correlation gets smaller), the gain can be reduced up to a lowest boundary by the JNLD threshold energy. Since the correlation is too small (e.g., the correlation $\alpha$ in Formula 9-1 can become 0.3), a shape vector of a corresponding band is substituted with a random sequence.

The gain generating unit 160 delivers the gain generated in the step S170 and the step S175 to the multiplexing unit 180.

Subsequently, the multiplexing unit 180 transmits a bitstream in a manner that the substitution type information generated in the step S150 and the gain value generated in the step S175 are included in the bit stream [S178].

Meanwhile, the quantizing unit 140 generates spectral data (or quantized spectral coefficients) and a scale factor by performing quantization on the spectral coefficients generated in the step S110 using the masking threshold generated in the step S120. In doing so, Formula 2 is available. The spectral data and the scale factor are included in the bitstream by the multiplexing unit 180 as well.

Figure 3:
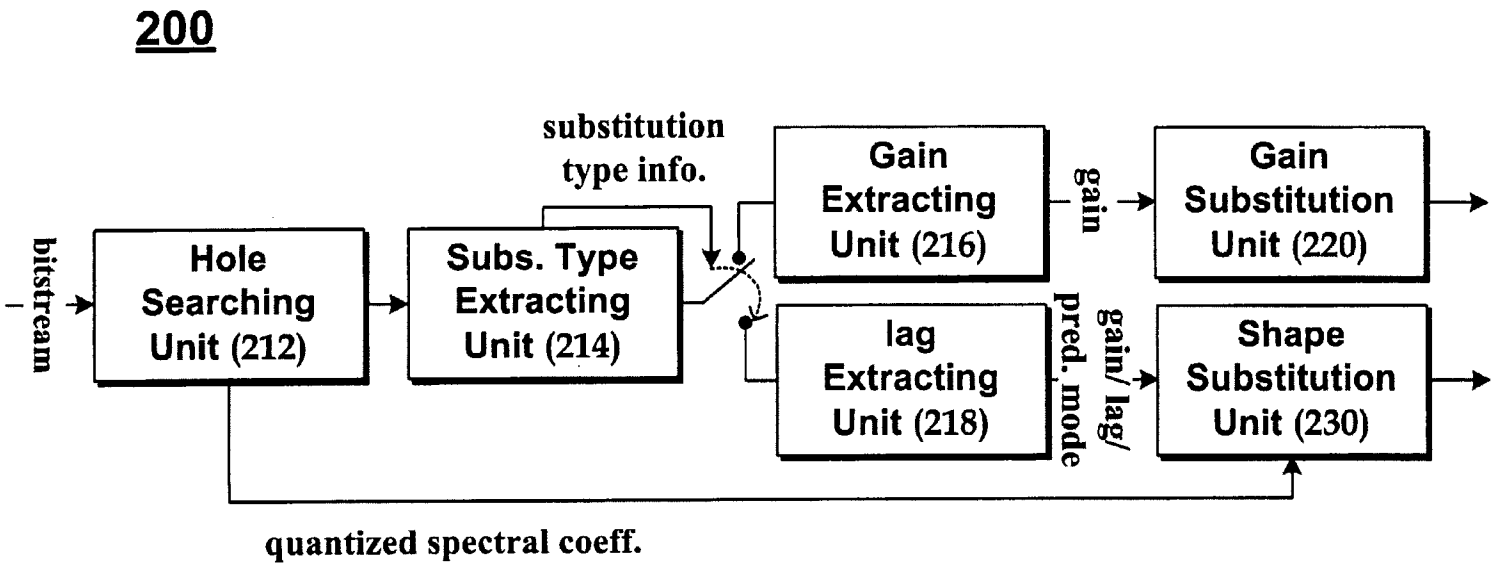
FIG. 3 is a block diagram of a decoder in an audio signal processing apparatus according to the present invention.
Figure 4:
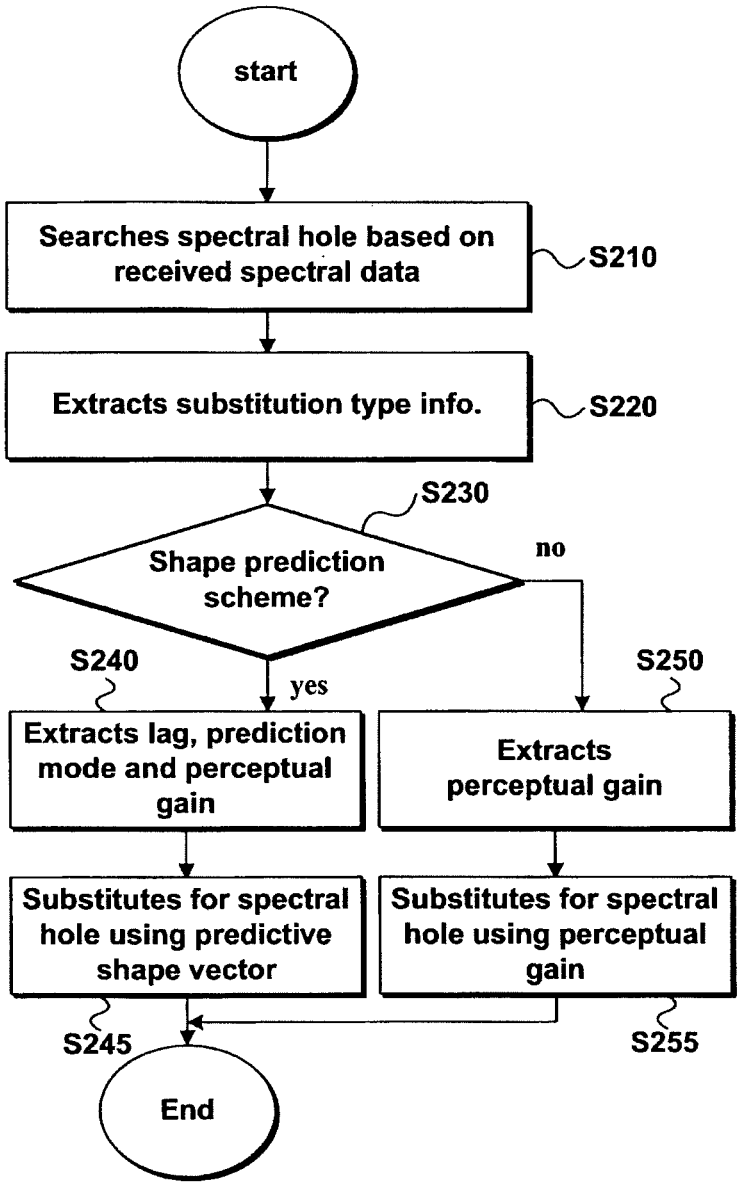
FIG. 4 is a flowchart of a decoding step in an audio signal processing method.

FIG. 3 is a block diagram of a decoder in an audio signal processing apparatus according to the present invention, and FIG. 4 is a flowchart of a decoding step in an audio signal processing method.

Referring to FIG. 3, a decoder 200 in an audio signal processing apparatus includes a gain substitution unit 220 and a shape substitution unit 230 and is able to further include a demultiplexer 210 (not shown in the drawing). In this case, the demultiplexer 210 further includes at least one of a hole searching unit 212, a substitution type extracting unit 214, a gain extracting unit 216 and a lag extracting unit 218. In the following description, functions and roles of the respective components are explained with reference to FIG. 3 and FIG. 4.

Figure 5:
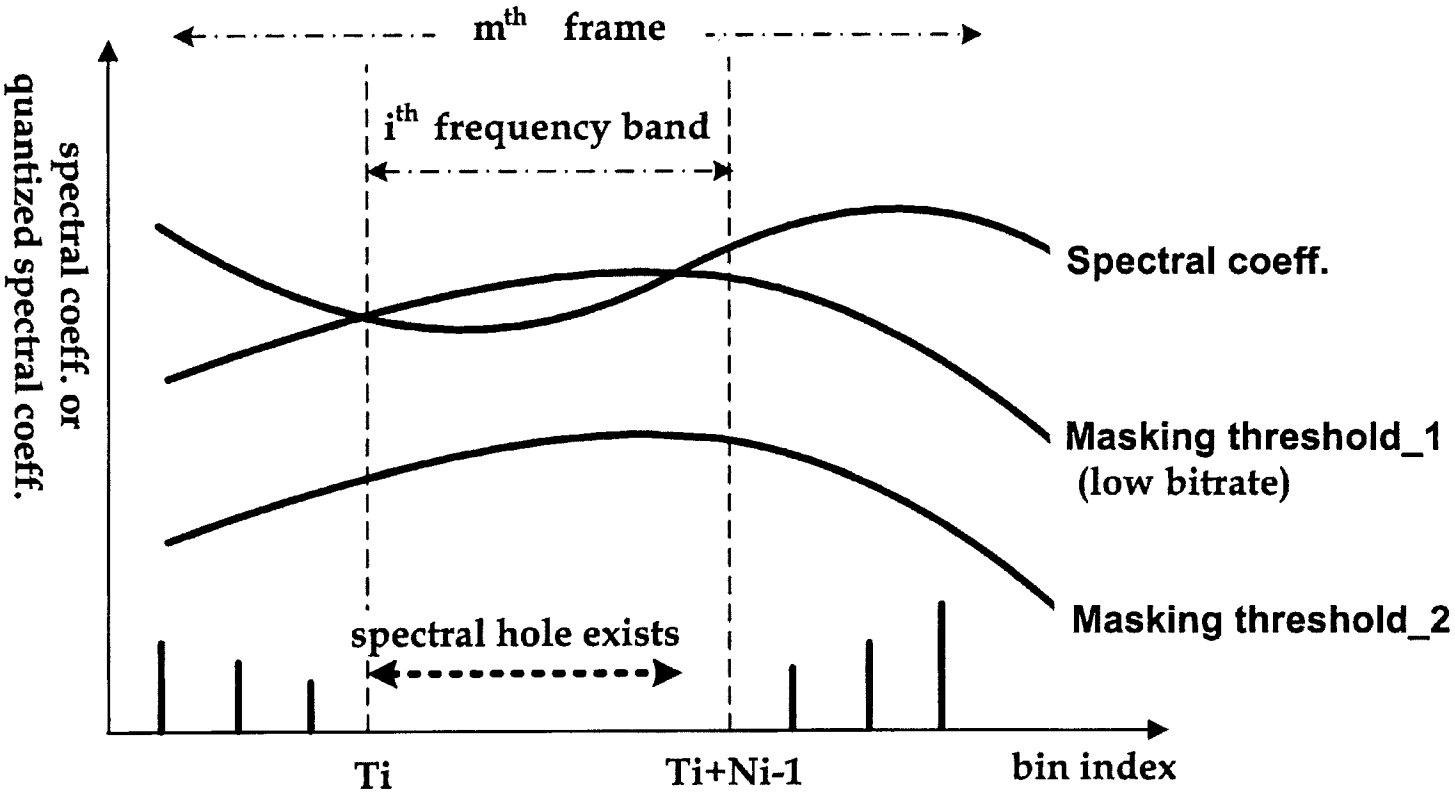
FIG. 5 is a diagram for concept of a spectral hole.

First of all, the hole searching unit 212 searches a location (i.e., a prescribed band in a prescribed frame) of a spectral hole using the received spectral data (or the received quantized spectral coefficients) [S210]. FIG. 5 is a diagram for concept of a spectral hole. Referring to FIG. 5, as mentioned in the foregoing description of the hole detecting unit 130 shown in FIG. 1, the spectral hole can be generated in an interval in which a spectral coefficient is smaller than a masking curve. In particular, if the masking curve rises due to a low bit rate environment (i.e., masking threshold_2 is changed into masking threshold_1 in FIG. 5), data becomes meaningless or insignificant. Therefore, a spectral home having the transmitted data (e.g., the quantized spectral coefficient or the spectral data) set to 0 is generated. This spectral hole may be generated from a whole or partial part of 1th frequency band (i.e., current band) of m* frame (i.e., current frame). In case that the spectral hole exists in the partial part of the current band, it is able to generate a substitution signal for the whole current band or a substitution signal for a bin having no spectral hole in the current band only, by which the present invention is non-limited.

After the spectral hole existing frame, band and bin and the like have been identified by searching the spectral hole in the step S210, substitution type information is extracted from the bitstream based on the identity result [S220]. If the substitution type information is transmitted in each frame (or each band) irrespective of the existence of the spectral hole, it is able to extract the substitution type information irrespective of the existence of the spectral hole. In this case, the substitution type information is the information indicating whether a shape prediction scheme is applied to the current block. The current block can correspond to a current frame or a current band. Moreover, the substitution type information can include the information indicating whether to substitute the spectral hole existing in the current block by the current prediction scheme or to substitute the spectral hole using random signal and the perceptual gain.

Afterwards, according to the substitution type information extracted in the step S220, the following steps proceed. If the substitution type scheme indicates that the shape prediction scheme is applied to the current frame (or the current band) [yes in the step S230], the lag extracting unit 218 extracts lag information, prediction mode information and perceptual gain from the bitstream [S240]. In this case, the lag information means an interval between the current band (or the spectral coefficient of the current band) and the predictive shape vector. In particular, the lag information can include the lag $D_{m,i}$ shown in Formula 6. The prediction mode information can include the prediction mode information K shown in Formula 6 and indicates an intra frame mode or an inter frame mode. The perceptual gain is gain generated in steps of S170 and S175.

Subsequently, the shape substitution unit 230 obtains the spectral coefficients of the current band (or a partial part of the current band) by substituting the spectral hole using the lag information and the prediction mode information [S245]. First of all, a predictive shape vector corresponding to the lag information and the prediction mode information is determined. In this case, the predictive shape vector can include the former predictive shape vector or the unit predictive shape vector shown in Formula 6.

For instance, in case that the prediction mode is intra frame, the predictive shape vector is obtained from the spectral data in a current frame. If the prediction mode is inter frame, the predictive shape vector is obtained from the spectral data in a previous frame. In this case, the previous frame is non-limited by a frame just prior to the current frame. In other words, if the current frame is m* frame, the previous frame is able to correspond to (m−k)* frame (where k is equal to or greater than 2) as well as (m−1)* frame. Since the lag information indicating the interval between the predictive shape vector and the current band, the predictive shape vector is determined using the spectral data of the current or previous frame spaced apart by the interval indicated by the lag information. When the shape prediction scheme is applied, modeling error can occur in course that spectrum of original signal is modeled. The error can be compensated by using gain control with the perceptual gain. The perceptual gain is the same as a perceptual gain, which will be explained with reference to S250 step.

By substituting the spectral hole using the predictive shape vector (or the unit predictive shape vector) determined through the above process, the spectral coefficients of the current band (or the partial part of the current band) are obtained [S245].

On the contrary, in the step S230, if the substitution type information indicates that the shape prediction scheme is not applied to the current frame (or the current band) [no in the step S230], the gain extracting unit 216 extracts a perceptual gain from the bitstream [S250]. In this case, the perceptual gain is the gain defined in Formula 9-1 and, as mentioned in the foregoing description, is the gain value using the psychoacoustic model (or the JNLD value based on the psychoacoustic model) and the correlation. FIG. 6 is a diagram for a range of a perceptual gain and shows the range of the perceptual gain. Referring to FIG. 6, the correlation is close to 1, the left side ($g_0=g_{m,i}$) of Formula 9-1 remains only. Hence, the perceptual gain value is independent from the JNLD value and is determined as the spectral coefficients only like Formula 9-2. Yet, if the correlation is close to 0, the right side ($g_{JNLD}=\sqrt{g_{m,i}^2\cdot 10^{-J_{m,i}/10}}$) of Formula 9-1 remains only. Hence, the perceptual gain value becomes dependent on the JNLD value.

In particular, the correlation between shape vectors predicted from the spectral data of the previous or current frame is big, the spectral hole can be substituted with a signal similar to a level of an original signal. On the contrary, if the correlation is small, if the spectral hole is substituted with a signal identical to a level of the original signal, it may be harsh to the ear. Therefore, the gain is lowered into to $\sqrt{g_{m,i}^2\cdot 10^{-J_{m,i}/10}}$) to substitute the spectral hole with a signal having a level lower than that of the original.

After the perceptual value having the above-mentioned property has been extracted [S250], spectral coefficients for the current band are generated in a manner of substituting the spectral hole using the extracted perceptual gain value [S255]. For instance, the spectral coefficients are generated by substituting the spectral hole or the current band including the spectral hole with a random signal having a maximum level set to the perceptual gain value in a manner of applying the perceptual gain value to the random signal having the maximum size set to 1.

Afterwards, by performing inverse frequency transform using the spectral coefficients generated through the step S245 or the step S255, an output signal for the current frame is generated.

Figure 7:
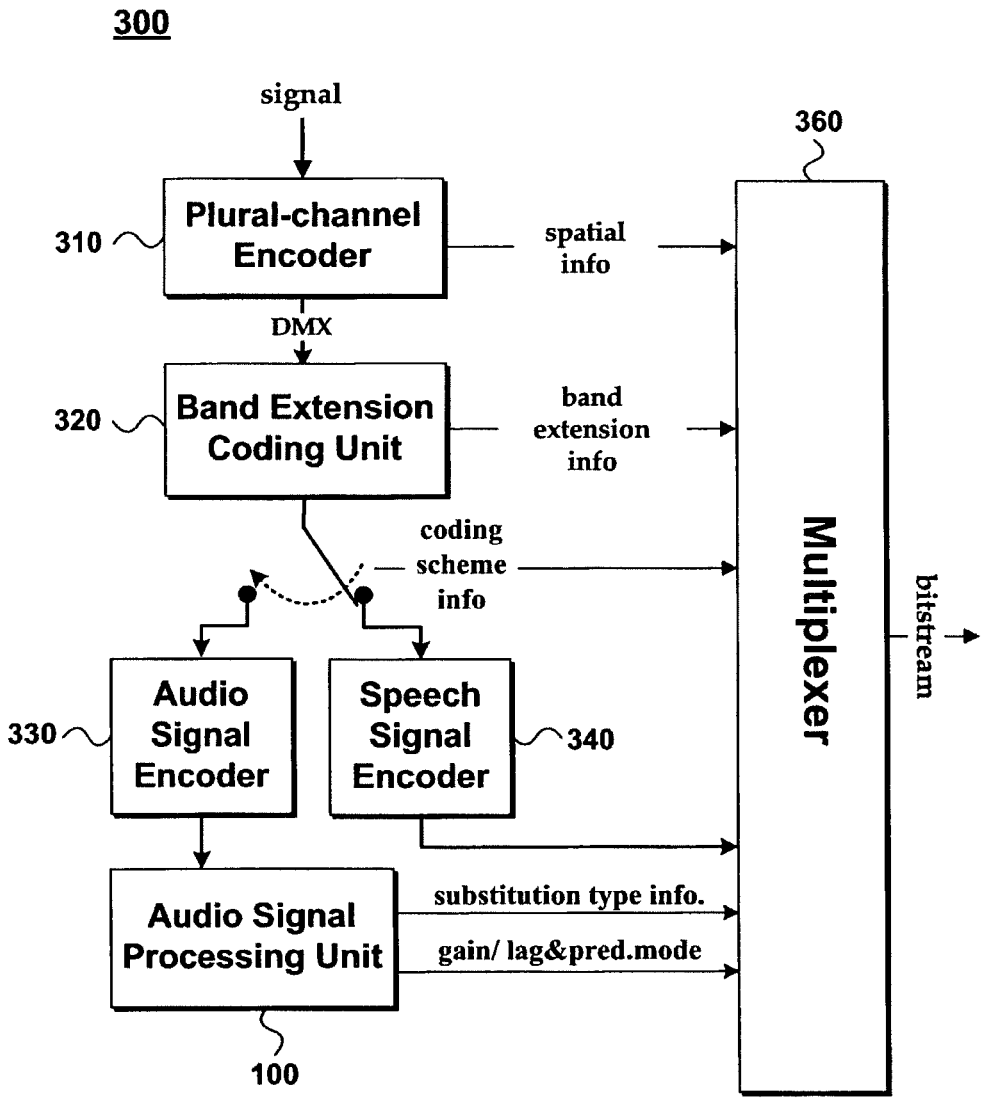
FIG. 7 is a block diagram for one example of an audio signal encoding apparatus to which an encoder is applied according to an embodiment of the present invention.
Figure 8:
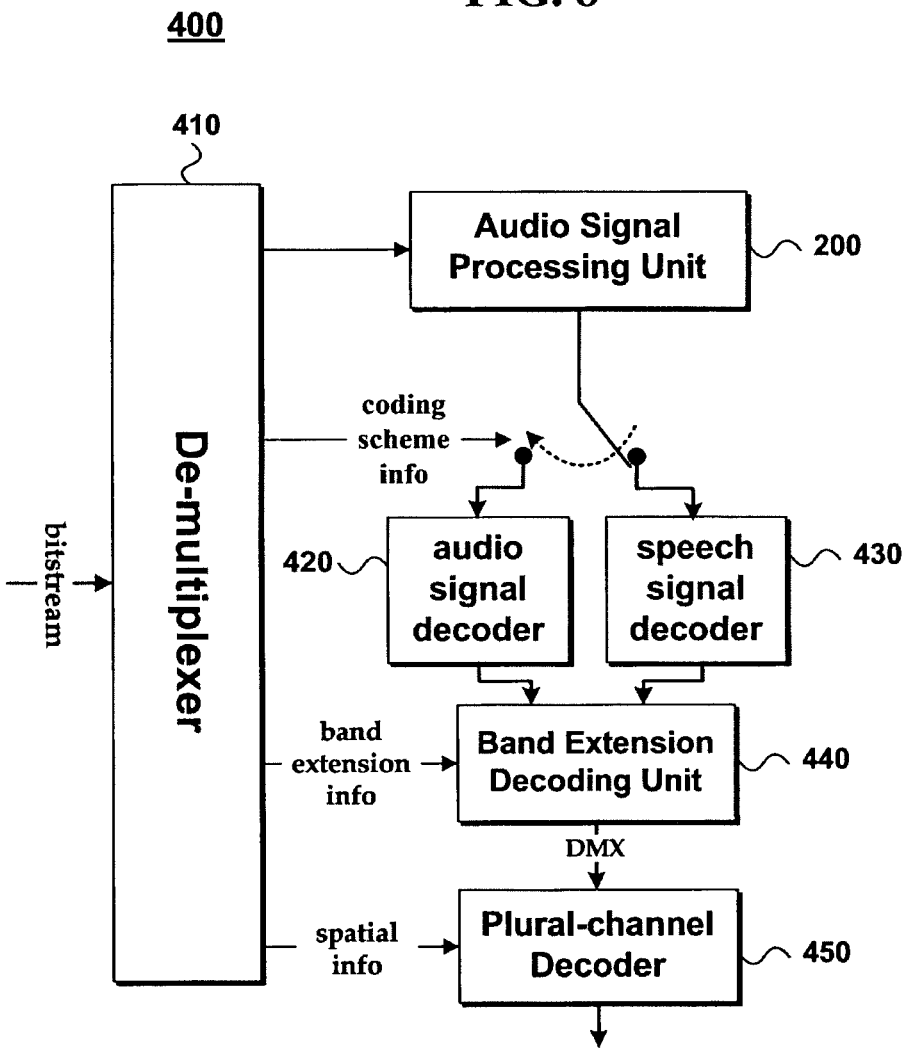
FIG. 8 is a block diagram for one example of an audio signal decoding apparatus to which a decoder is applied according to an embodiment of the present invention.

FIG. 7 is a block diagram for one example of an audio signal encoding apparatus to which an encoder is applied according to an embodiment of the present invention, and FIG. 8 is a block diagram for one example of an audio signal decoding apparatus to which a decoder is applied according to an embodiment of the present invention.

Referring to FIG. 7, an audio signal processing apparatus 100 is able to include at least one of the substitution type selecting unit 150, the gain generating unit 160 and the shape prediction unit 170 described with reference to FIG. 1. Referring to FIG. 8, an audio signal processing apparatus 200 includes the gain substitution unit 220 and the shape substitution unit 230 described with reference to FIG. 3 and is able to further include the rest of the components.

Referring to FIG. 7, an audio signal encoding apparatus 300 includes a plural channel encoder 310, a band extension encoding unit 320, an audio signal encoder 330, a speech signal encoder 340, an audio signal encoding apparatus 100, and a multiplexer 360.

The plural channel encoder 310 receives an input of a plural channel signal (e.g., a signal having at least two channels), generates a mono or stereo downmix signal by downmixing the inputted plural channel signal, and also generates spatial information necessary to upmix the downmix signal into a multichannel signal. In this case, the spatial information can include channel level difference information, channel prediction coefficients, inter-channel correlation information, downmix gain information and the like. If the audio signal encoding apparatus 300 receives an input of a mono signal, downmixing is not performed and the mono signal can bypass the plural channel encoder 310.

The band extension encoding unit (band extension encoder) 320 is then able to generate spectral data corresponding to a low frequency band and band extension information for high frequency band extension. In particular, the spectral data of a partial band (e.g., high frequency band) of the downmix signal is excluded. And, band extension information for reconstructing the excluded data can be generated.

The signal generated through the band extension coding unit 320 is inputted to the audio signal encoder 330 or the speech signal encoder 340 according to coding scheme information generated by a signal classifier (not shown in the drawing).

If a specific frame or segment of a specific frame or segment of the downmix signal has a dominant audio property, the audio signal encoder 330 encodes the downmix signal by an audio coding scheme. In this case, the audio coding scheme follows AAC (advanced audio coding) standard or HE-AAC (high efficiency advanced audio coding) standard, by which the present invention is non-limited. And, the audio signal encoder 330 can correspond to MDCT (modified discrete transform) encoder.

If a specific frame or segment of a specific frame or segment of the downmix signal has a dominant speech property, the speech signal encoder 340 encodes the downmix signal by a speech scheme. In this case, the speech coding scheme may follow the AMR-WB (adaptive multi-rate wide-band) standard, by which the present invention is non-limited. Meanwhile, the speech signal encoder 340 is able to further use linear prediction coding (LPC) scheme. If a harmonic signal has high redundancy on a time axis, modeling is possible by the linear prediction that predicts a current signal from a past signal. Therefore, if the linear prediction coding scheme is adopted, coding efficiency can be raised. Moreover, the speech signal encoder 340 can correspond to a time domain encoder.

The audio signal processing unit 100 includes at least one of the components describe with reference to FIG. 1 and generates substitution type information. In case of not applying the shape prediction scheme, the audio signal processing unit 100 generates gain information (e.g., perceptual gain value). In case of applying the shape prediction scheme, the audio signal processing unit 100 generates lag information and prediction mode information and then delivers them to the multiplexer 360.

The multiplexer 360 generates at least one or more bitstreams by multiplexing the spatial information, the band extension information, the signal encoded by each of the audio signal encoder 330 and the speech signal encoder 340, the substitution type information generated by the audio signal processing unit 100, the gain information generated by the audio signal processing unit 100, the lag information generated by the audio signal processing unit 100, the prediction mode information generated by the audio signal processing unit 100 and the like together.

Referring to FIG. 8, the audio signal decoding apparatus 400 includes a demultiplexer 410, an audio signal processing apparatus 200, an audio signal decoder 420, a speech signal decoder 430, a band extension decoding unit 440 and a plural channel decoder 470.

The demultiplexer 410 extracts the quantized signal, code scheme information, band extension information, spatial information and the like from an audio signal bitstream.

As mentioned in the foregoing description, the audio signal processing unit 200 includes at least one of the components described with reference to FIG. 3 and generates the spectral coefficients for the spectral hole according to the substitution type information. In particular, by applying the shape prediction scheme, the spectral hole is substituted. Alternatively, without applying the shape prediction scheme, the spectral hole is substituted using a random signal based on a perceptual gain value.

If an audio signal (e.g., spectral coefficient) has a dominant audio property, the audio signal decoder 420 decodes the audio signal by an audio coding scheme. In this case, as mentioned in the foregoing description, the audio coding scheme can follow the AAC standard or the HE-AAC standard. If the audio signal has a dominant speech property, the speech signal decoder 430 decodes the downmix signal by a speech coding scheme. In this case, the speech coding scheme can follow the AMR-WB standard, by which the present invention is non-limited.

The band extension decoding unit 440 reconstructs a signal of a frequency band based on the band extension information by performing a band extension decoding scheme on the output signals of the audio and speech signal decoders 420 and 430.

If the decoded audio signal is a downmix, the plural channel decoder 450 generates an output channel signal of the multichannel signal (e.g., stereo signal included) using the spatial information.

The audio signal processing apparatus according to the present invention is available for various products to use. Theses products can be mainly grouped into a stand alone group and a portable group. A TV, a monitor, a settop box and the like can be included in the stand alone group. And, a PMP, a mobile phone, a navigation system and the like can be included in the portable group.

Figure 9:
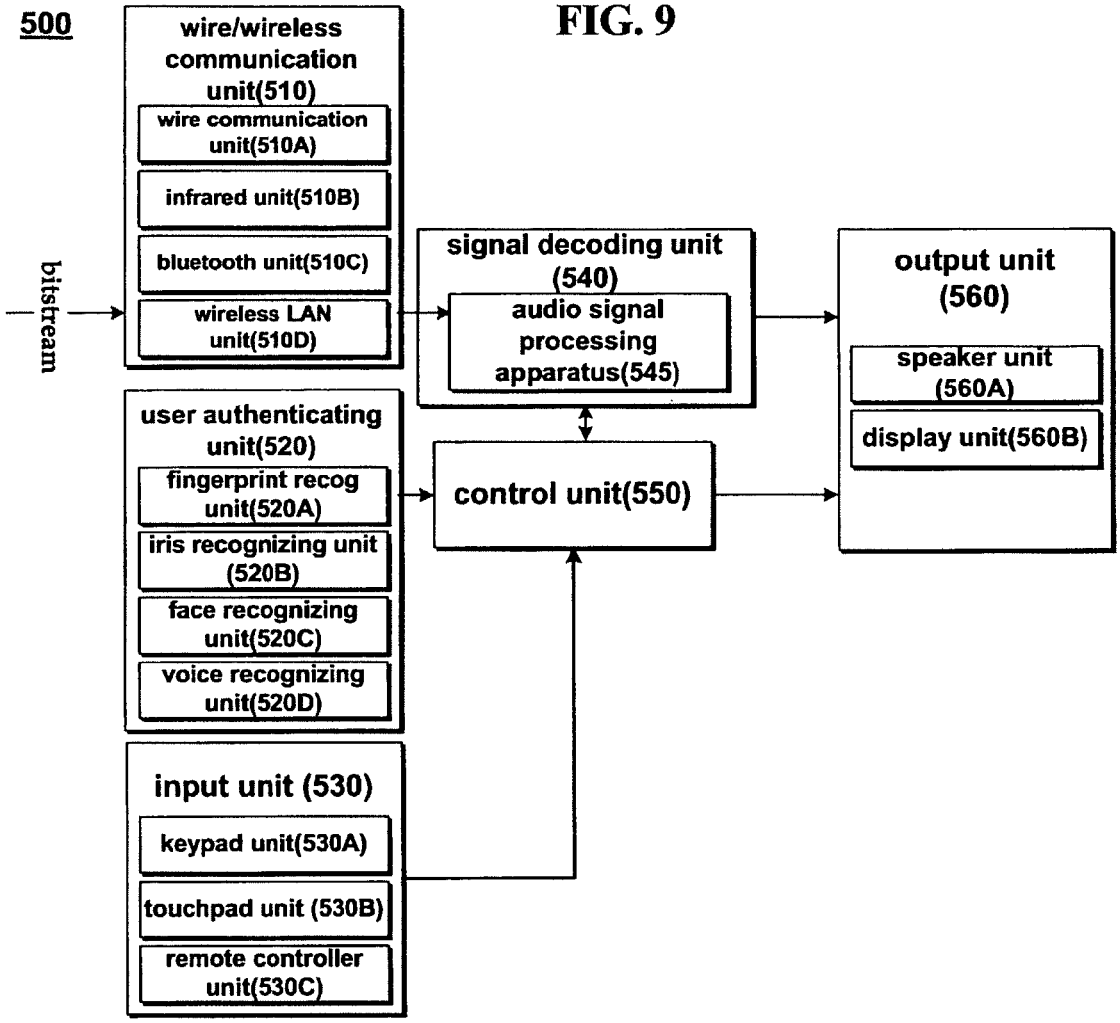
FIG. 9 is a schematic block diagram of a product in which an audio signal processing apparatus according to the present invention is implemented.

FIG. 9 shows relations between products, in which an audio signal processing apparatus according to one embodiment of the present invention is implemented.

Referring to FIG. 14, a wire/wireless communication unit 510 receives a bitstream via wire/wireless communication system. In particular, the wire/wireless communication unit 510 can include at least one of a wire communication unit 510A, an infrared unit 510B, a Bluetooth unit 510C and a wireless LAN unit 510D.

A user authenticating unit 520 receives an input of user information and then performs user authentication. The user authenticating unit 520 can include at least one of a fingerprint recognizing unit 520A, an iris recognizing unit 520B, a face recognizing unit 520C and a voice recognizing unit 520D. The fingerprint recognizing unit 520A, the iris recognizing unit 520B, the face recognizing unit 520C and the speech recognizing unit 520D receive fingerprint information, iris information, face contour information and voice information and then convert them into user informations, respectively. Whether each of the user informations matches pre-registered user data is determined to perform the user authentication.

An input unit 530 is an input device enabling a user to input various kinds of commands and can include at least one of a keypad unit 530A, a touchpad unit 530B and a remote controller unit 530C, by which the present invention is non-limited.

A signal coding unit 540 performs encoding or decoding on an audio signal and/or a video signal, which is received via the wire/wireless communication unit 510, and then outputs an audio signal in time domain. The signal coding unit 540 includes an audio signal processing apparatus 545. As mentioned in the foregoing description, the audio signal processing apparatus 545 corresponds to the above-described embodiment (i.e., the encoder side 100 and/or the decoder side 200) of the present invention. Thus, the audio signal processing apparatus 545 and the signal coding unit including the same can be implemented by at least one or more processors.

A control unit 550 receives input signals from input devices and controls all processes of the signal decoding unit 540 and an output unit 560. In particular, the output unit 560 is an element configured to output an output signal generated by the signal decoding unit 540 and the like and can include a speaker unit 560A and a display unit 560B. If the output signal is an audio signal, it is outputted to a speaker. If the output signal is a video signal, it is outputted via a display.

Figure 10:
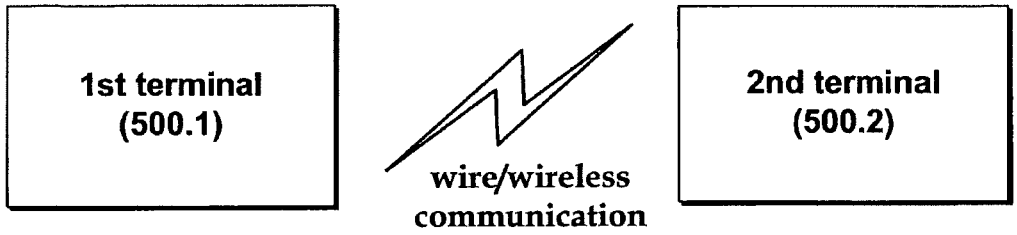
FIG. 10 is a diagram for explaining relations between products in which an audio signal processing apparatus according to the present invention is implemented.
Figure 10:
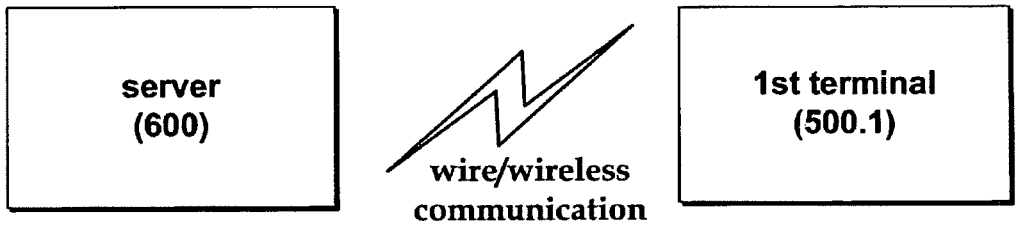

FIG. 10 is a diagram for relations of products provided with an audio signal processing apparatus according to an embodiment of the present invention. FIG. 10 shows the relation between a terminal and server corresponding to the products shown in FIG. 9.

Referring to FIG. 10 (A), it can be observed that a first terminal 500.1 and a second terminal 500.2 can exchange data or bitstreams bi-directionally with each other via the wire/wireless communication units. Referring to FIG. 10 (B), it can be observed that a server 600 and a first terminal 500.1 can perform wire/wireless communication with each other.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). And, a bitstream generated by the above mentioned encoding method can be stored in the computer-readable recording medium or can be transmitted via wire/wireless communication network.

Industrial Applicability

Accordingly, the present invention is applicable to processing and outputting an audio signal.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method for decoding an audio signal, the method comprising:

receiving, by an audio processing apparatus, spectral data including a current block having a spectral hole, and substitution type information indicating whether to apply a shape prediction scheme to the current block, based on the substitution type information indicating that the shape prediction scheme is applied to the current block, receiving lag information indicating an interval between spectral coefficients of the current block and a predictive shape vector of the shape prediction scheme, and wherein the substitution type information is determined based on a correlation value between spectral coefficients of the current block and the predictive shape vector, the correlation value is estimated by using a candidate lag value ($d_k$), and based on the correlation value being greater than or equal to a predetermined value, the shape prediction scheme is applied to the current block having the spectral hole;

obtaining spectral coefficients by substituting for spectral hole included in the current block using the lag information; and decoding the spectral coefficients to output the audio signal.

2. The method of claim 1, further comprising:

receiving prediction type information indicating whether a prediction mode of the shape prediction scheme is intra-frame mode or inter-frame mode, wherein the spectral coefficients are obtained using further the prediction mode.

3. The method of claim 2, wherein:

based on the prediction mode being intra-frame mode, the predictive shape vector is decided by the spectral data of the current frame, based on the prediction mode being inter-frame mode, the predictive shape vector is decided by the spectral data of the previous frame.

4. The method of claim 1, wherein the predictive shape vector is determined by the spectral data of the current frame or the previous frame as far as the interval from the current block.

5. The method of claim 1, further comprising:

based on the type information indicating that the shape prediction scheme is not applied to the current block, receiving a perceptual gain value, wherein the perceptual gain value is determined by psychoacoustic model and correlation; obtaining spectral coefficients by substituting for the spectral hole included in the current block using the perceptual gain value.

6. The method of claim 1, wherein:

the psychoacoustic model is based on excitation pattern obtained by smoothing energy pattern of frequency band, the perceptual gain value is further independent of the psychoacoustic model based on the correlation increasing, and the perceptual gain value is further dependent on the psychoacoustic model based on the correlation decreasing.

7. The method of claim 1, wherein the current block corresponds to at least one of a current band and a current frame including the current band.

8. The method of claim 1, wherein the candidate lag value ($d_k$) is a difference between the spectral coefficient of the current block and the spectral coefficient of the predictive shape vector.

9. A method for encoding an audio signal, the method comprising:

receiving, by an audio processing apparatus, spectral coefficients of an input audio signal;

detecting spectral hole by de-quantizing the spectral coefficient;

estimating at least one correlation between at least one candidate shape vector and a current block covering the spectral hole, wherein a correlation value is estimated by using a candidate lag value ($d_k$);

determining substitution type information indicating whether to apply a shape prediction scheme to the current block based on the at least one correlation;

wherein based on the estimated correlation value being equal to or greater than a predetermined value, the shape prediction scheme is applied to the current block covering the spectral hole, based on the shape prediction scheme being applied to the current block, determining prediction mode information and lag information, based on the at least one correlation; and, multiplexing, by a multiplexer, the substitution type information, the prediction mode information and the lag information to form a bitstream, wherein:

the prediction mode information indicates whether a prediction mode of the shape prediction scheme is intra-frame mode or inter-frame mode, and the lag information indicates an interval between spectral coefficients of the current block and the predictive shape vector of a current frame or a previous frame.

10. An apparatus configured to decode an audio signal, the apparatus comprising:

an audio signal processor that includes:

a substitution type extracting unit configured to receive spectral data including a current block having a spectral hole, and substitution type information indicating whether to apply a shape prediction scheme to the current block;

a lag extracting unit configured to, based on the substitution type information indicating that the shape prediction scheme is applied to the current block, receive lag information indicating an interval between spectral coefficients of the current block and a predictive shape vector of the shape prediction scheme, wherein the substitution type information is determined based on a correlation value between spectral coefficients of the current block and the predictive shape vector, the correlation value is estimated by using a candidate lag value ($d_k$), and based on the correlation value being equal to or greater than a predetermined value, the shape prediction scheme is applied to the current block having the spectral hole; and a shape substitution unit configured to obtain spectral coefficients by substituting for spectral hole included in the current block using lag information; and an audio signal decoder configured to decode the spectral coefficients to output the audio signal.

11. The apparatus of claim 10, wherein the lag extracting unit is configured to receive prediction type information indicating whether a prediction mode of the shape prediction scheme is intra-frame mode or inter-frame mode, wherein the spectral coefficients are obtained using further the prediction mode.

12. The apparatus of claim 11, wherein:

based on the prediction mode being intra-frame mode, the predictive shape vector is decided by the spectral data of the current frame, based on the prediction mode being inter-frame mode, the predictive shape vector is decided by the spectral data of the previous frame.

13. The apparatus of claim 10, wherein the predictive shape vector is determined by the spectral data of the current frame or the previous frame as far as the interval from the current block.

14. The apparatus of claim 10, further comprising:

a gain extracting unit configured to, based on the type information indicating that the shape prediction scheme is not applied to the current block, receive a perceptual gain value, wherein the perceptual gain value is determined by psychoacoustic model and correlation; and, a gain substitution unit configured to obtain spectral coefficients by substituting for the spectral hole included in the current block using the perceptual gain value.

15. The apparatus of claim 10, wherein:

the psychoacoustic model is based on excitation pattern obtained by smoothing energy pattern of frequency band, the perceptual gain value is further independent of the psychoacoustic model based on the correlation increasing, and the perceptual gain value is further dependent on the psychoacoustic model based on the correlation decreasing.

16. The apparatus of claim 10, wherein the current block corresponds to at least one of a current band and a current frame including the current band.

17. An apparatus configured to encode an audio signal, the apparatus comprising:

a hole detecting unit configured to receive spectral coefficients of an input audio signal, and to detect spectral hole by de-quantizing the spectral coefficient;

a substitution type selecting unit configured to:

estimate at least one correlation between at least one candidate shape vector and a current band covering the spectral hole, wherein a correlation value is estimated by using a candidate lag value ($d_k$); and determine substitution type information indicating whether to apply a shape prediction scheme to the current band based on the at least one correlation, wherein based on the estimated correlation value being equal to or greater than a predetermined value, the shape prediction scheme is applied to the current block covering the spectral hole;

a shape prediction unit configured to, based on the shape prediction scheme being applied to the current band, determine prediction mode information and lag information, based on the at least one correlation; and a multiplexing unit configured to transmit the substitution type information, the prediction mode information and the lag information, wherein:

the prediction mode information indicates whether a prediction mode of the shape prediction scheme is intra-frame mode or inter-frame mode, and the lag information indicates an interval between spectral coefficients of the current block and the predictive shape vector of a current frame or a previous frame.

* * * * *